United States Patent [19]

Zamboni

[11] 4,125,915

[45] Nov. 21, 1978

[54] BOARD BRUSH FOR ICE-RESURFACING MACHINE

[75] Inventor: Richard F. Zamboni, Paramount, Calif.

[73] Assignee: Frank J. Zamboni & Co., Inc., Paramount, Calif.

[21] Appl. No.: 772,831

[22] Filed: Feb. 28, 1977

[51] Int. Cl.[2] ..... E01H 1/02; A46B 13/00

[52] U.S. Cl. ..... 15/21 E; 37/43 R; 15/49 C; 15/82

[58] Field of Search ..... 37/5, 43 R; 15/21 R, 15/21 E, 23, 55, 78, 82; 299/49 C, 39

[56] References Cited

U.S. PATENT DOCUMENTS

| | | | |
|---|---|---|---|
| 2,631,314 | 3/1953 | Fitzpatrick | 15/83 |
| 2,655,678 | 10/1953 | Keogh | 37/43 R X |
| 2,732,573 | 1/1956 | Hyland | 15/82 |
| 3,066,745 | 12/1962 | Smith et al. | 15/21 R |
| 3,622,205 | 11/1971 | Zamboni | 37/5 |

FOREIGN PATENT DOCUMENTS

| | | | |
|---|---|---|---|
| 2,225,027 | 4/1973 | France | 15/82 |

*Primary Examiner*—E. H. Eickholt
*Attorney, Agent, or Firm*—Herbert E. Kidder

[57] ABSTRACT

A board brush apparatus for use on a self-propelled ice-resurfacing machine of the type having a frame supporting apparatus for shaving the surface of the ice and removing the shavings, and including a source of pressurized hydraulic fluid. The apparatus includes a mounting bracket that is adapted to be attached to the frame on one side of the machine, and swingably connected to this frame is an arm having a motor-driven rotary brush at the outer end thereof. The arm is swingable between a laterally extending operational position and a retracted position, and is moved from one position to the other by a hydraulic cylinder which is attached at one end to the bracket. The piston rod projecting from the other end of the cylinder is connected to the arm through an intermediate shock absorber. The motor driving the brush is a hydraulic motor, which is connected to the source of fluid pressure on the machine by a fluid line that is also connected to that end of the cylinder which, when pressurized, extends the cylinder to swing the arm out to operative position. A control valve is connected into the fluid lines, and when the valve is turned to one position, the cylinder is extended and the motor is simultaneously started up. Turning the valve to the other position causes the cylinder to retract and the brush motor to shut off.

2 Claims, 2 Drawing Figures

BOARD BRUSH FOR ICE-RESURFACING MACHINE

BACKGROUND OF THE INVENTION

The present invention pertains to ice resurfacing equipment, and more particularly to what is known as a board brush apparatus for use on a self-propelled ise resurfacing machine of the type shown and described in U.S. Pat. No. 3,622,205.

In virtually all indoor ice skating rinks, the ice sheet is separated from the surrounding area by a low wooden fence, known as the dasher boards. When ice is resurfaced by a machine of the type shown in the above-mentioned patent, the operator drives the machine as closely as possible along the dasher boards, but practical considerations make it impossible for him to clear away the shaved ice that tends to accumulate at the base of the boards and for as much as a foot out from the boards. As a result, the shaved ice tends to freeze up, producing a "dished" effect which detracts from the appearance of the newly shaved ice.

SUMMARY OF THE INVENTION

The primary object of the present invention is to provide an apparatus that can be mounted on the side of the ice-resurfacing machine and reaches out laterally to the base of the dasher boards to sweep the accumulated shaved ice in toward the center of the machine, so that the shaved-ice gathering equipment on the machine can pick it up and deposit it in the receptacle box on the machine.

An important object of the invention is to provide an apparatus of the type described, in which the shaved ice sweeping mechanism is yieldingly held in the extended position, so that it can give way under impact loads without being damaged.

A further object of the invention is to provide a board brush apparatus in which the motor-driven rotary brush is caused to start running by the extension of the supporting arm out to the operative position, and the motor is automatically shut off when the supporting arm is retracted to the transport position.

These objects are achieved by providing an arm which is pivotally supported on one side of the ice resurfacing machine for swinging movement between a laterally extending operative position and a retracted transport position. Mounted on the outer end of the arm is a rotary brush driven by a hydraulic motor. The brush is swung from one of its positions to the other by means of a hydraulic cylinder which is connected to the arm through an intermediate shock absorber. The fluid line supplying high pressure hydraulic fluid to the motor is also connected to that end of the cylinder which, when pressurized, extends the cylinder to swing the arm out to its operative position. Thus, when pressure fluid is directed to the cylinder to extend the arm, it also starts up the brush motor, and when the cylinder is retracted, the motor is shut off.

The foregoing and other objects and advantages of the invention will become apparent to those skilled in the art from the following detailed description of the preferred embodiment thereof, with reference to the accompanying drawings.

DESCRIPTION OF THE PREFERRED EMBODIMENT

Figures 1, 2:
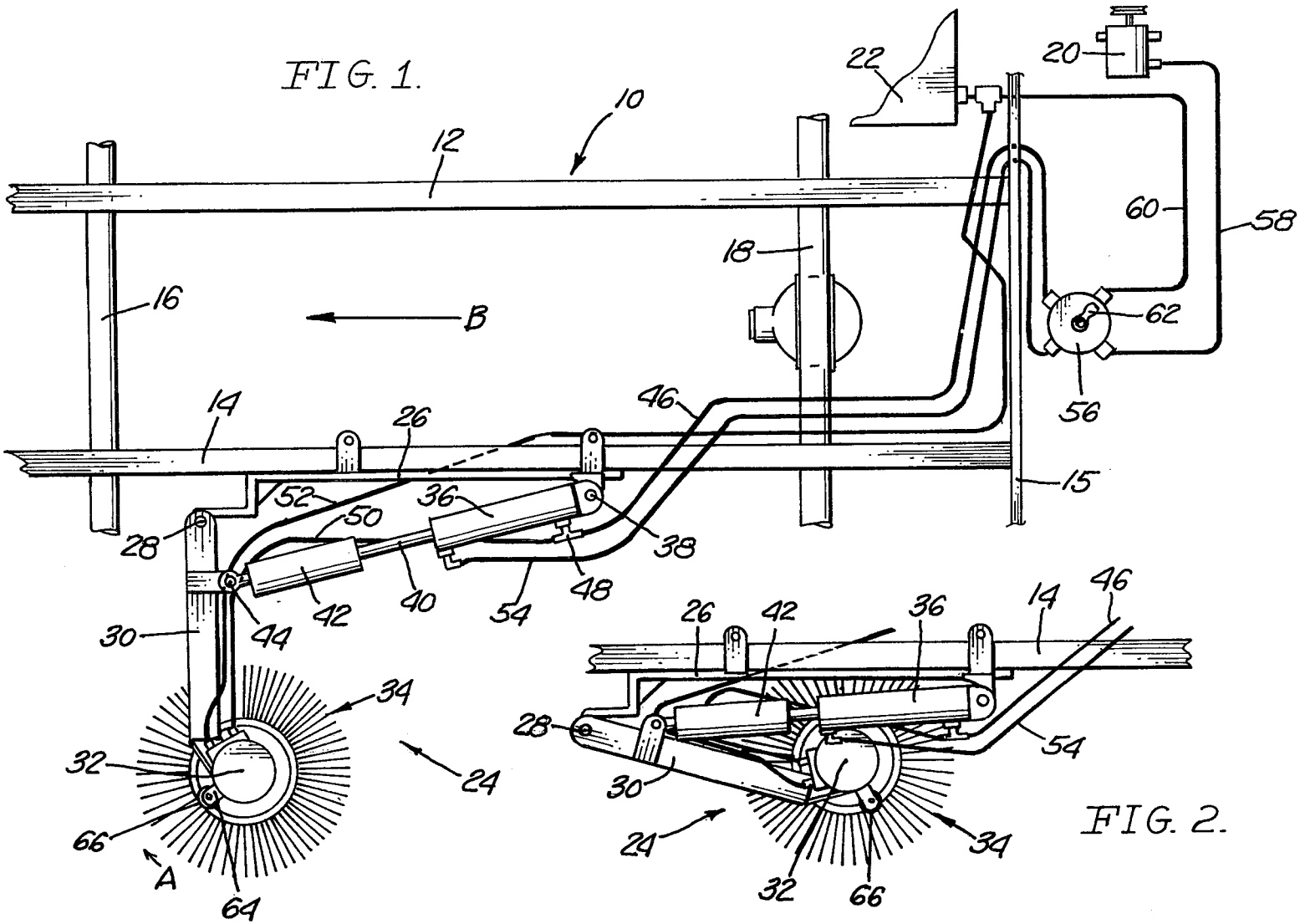
FIG. 1 is a more-or-less schematic plan view of the invention, showing the brush arm in the extended position.
FIG. 2 is a fragmentary view of the same, showing the arm retracted to the transport position.

In the drawings, the reference numeral 10 designates the frame of an ice rink resurfacing machine of the type shown and described in U.S. Pat. No. 3,622,205. The machine of the patent may be briefly described as comprising an automotive vehicle propelled by an internal combustion engine and having a transversely arranged blade at the rear end that shaves the surface of the ice; a horizontal worm screw conveyor that brings the shaved ice in toward the centerline of the machine; and a vertical conveyor that lifts the accumulated shaved ice and dumps it into a large receptacle carried by the machine. The several conveyors are driven by hydraulic motors that are supplied with high pressure fluid from a pump driven by the engine. For the purposes of this disclosure, the only part of the machine that is essential to an understanding of the invention is the frame 10, which comprises two laterally spaced, longitudinally extending frame members 12 and 14 connected by transverse members, of which only one member 15 is shown. The frame 10 is carried by front and rear axles 16 and 18, respectively, and mounted on the frame is a source 20 of hydraulic fluid pressure, and a reservoir tank 22. The fluid pressure source 20 is preferably the hydraulic motor driving the horizontal conveyor of the machine, although it could also comprise a pump driven by the engine.

The board brush apparatus of the present invention is designated in its entirety by the reference numeral 24, and as shown in FIG. 1, is mounted on one side of the machine (preferably the left-hand side) where it can be watched by the operator. The apparatus 24 includes a mounting bracket 26 which is attached to the outer side of the left-hand frame member 14, and swingably connected to the bracket by a pivot pin 28 is an arm 30. The arm 30 is swingable in a generally horizontal plane between the laterally extending operative position shown in FIG. 1 and the retracted transport position shown in FIG. 2. Mounted on the outer end of the arm 30 is a hydraulic motor 32 driving a rotary brush 34 that turns in the clockwise direction, as indicated by the arrow A. The bristles of the brush bear downwardly on the surface of the ice, and as the brush revolves, the shaved ice at the base of the dasher boards is swept inwardly toward the centerline of the machine so that it can be gathered up by the horizontal conveyor at the rear of the machine. The machine travels in the direction of the arrow B.

The arm 30 is swung from one of its positions to the other by means of a hydraulic cylinder 36, one end of which is connected by a pivot pin 38 to the bracket 26. Projecting from the other end of the cylinder is a piston rod 40, the outer end of which is connected to a shock absorber 42. Shock absorber 42 is connected, in turn, by a pivot pin 44 to the arm 30 at a point spaced radially outward from the pivot pin 28.

Both the hydraulic motor 32 and the cylinder 36 are supplied with high pressure fluid by a flexible high pressure fluid line 46, that is connected by a Tee-fitting 48 to the right-hand end of cylinder 36 which, when pressurized, extends the piston rod 40. Also connected to the other branch of Tee-fitting 48 is an extension high pressure fluid line 50, the other end of which is connected to the input port of the hydraulic motor 32. The output port of the motor is connected by a return line 52, which goes to the reservoir tank 22. A return line 54 is connected to the left-hand end of cylinder 36, and both line 54 and 46 are connected to control valve 56. A high pressure fluid line 58 extends from the source of fluid pressure (i.e., the horizontal conveyor motor 20) to the valve, and a return line 60 extends from the valve to the reservoir tank 22. A control handle 62 provides the means for actuating the valve.

Mounted on the outer end of the arm 30 is a U-shaped bracket 64, carrying a non-marking plastic roller 66, which is intended to contact the dasher boards if the machine should be driven too close to the boards, and the roller provides a rolling contact that avoids marking the boards. At the same time, pressure of the boards against the roller 66 causes the arm 30 to yield rearwardly as the shock absorber 42 is compressed.

The operation of the invention is as follows: To operate the brush, the operator merely moves the valve handle 62 to the position which sends high pressure fluid out through line 46 to the cylinder 36 and motor 32. This causes simultaneous extension of the cylinder 36 and operation of the motor 32. In this way, the boards may be brushed clean during the initial pass of the machine along its resurfacing pattern. Moving the valve handle 62 to the other position retracts the arm 30 and simultaneously turns off the brush motor without interfering with the conveyor operation or other resurfacing processes. In the transport position, the brush assembly is nestled neatly alongside the frame member 14, and will not interfere with the normal driving to and from the ice surface. The non-marking plastic roller 66 and the shock absorber 42 provide protection for the brush assembly and dasher boards during the brushing operation.

While I have shown and described in considerable detail what I believe to be the preferred form of my invention, it will be understood by those skilled in the art that the invention is not limited to such details but may take various other forms within the scope of the claims.

What I claim is:

1. A board brush apparatus for use on a self-propelled ice-resurfacing machine having a frame and a source of pressurized hydraulic fluid, said apparatus comprising:

a mounting bracket adapted to be attached to said frame on one side of the machine;

an arm pivotally connected at one end to said bracket for swinging movement in a generally horizontal plane between a laterally extending operative position and a retracted transport position;

a hydraulic motor mounted on the outer end of said arm and driving a rotary brush;

a hydraulic cylinder having a piston rod projecting from one end thereof, said hydraulic cylinder and piston rod being connected between said arm and said bracket whereby when the cylinder is extended said arm is swung out to said operative position, and when the cylinder is retracted, the arm is drawn back to said transport position;

fluid lines interconnecting both said cylinder and said hydraulic motor with a control valve which is connected, in turn, to said source of pressurized hydraulic fluid; said control valve being operable to activate both said cylinder and said hydraulic motor, whereby when said control valve is moved to one position, said hydraulic cylinder causes said piston rod to be extended to move said arm out to the operative position and said hydraulic motor is simultaneously caused to start rotating so as to drive said brush; and when the control valve is moved to another position, said cylinder causes said piston rod to retract said arm to the transport position and said hydraulic motor is simultaneously shut off.

2. Apparatus as in claim 1 for cleaning shaved ice from the dasher boards enclosing an indoor ice skating rink, which further includes a bracket fixed to the outer end of said arm, and a roller mounted in said bracket for rotation about a substantially vertical axis, said roller extending out to a point where it is adapted to contact the dasher boards if the machine should be driven too close to the boards, and the roller running on the boards so as to hold said brush away from the boards to prevent damage to the brush.

* * * * *